US006523401B2

(12) United States Patent
Oechsle et al.

(10) Patent No.: US 6,523,401 B2
(45) Date of Patent: Feb. 25, 2003

(54) MEASURING SYSTEM

(75) Inventors: Markus Oechsle, Bartholomae (DE); Frank Wegehaupt, Böhmenkirch (DE)

(73) Assignee: Voith Paper Patent GmbH, Heidenheim (DE)

( * ) Notice: Subject to any disclaimer, the term of this patent is extended or adjusted under 35 U.S.C. 154(b) by 0 days.

(21) Appl. No.: 09/816,390

(22) Filed: Mar. 26, 2001

(65) Prior Publication Data

US 2001/0032502 A1 Oct. 25, 2001

(30) Foreign Application Priority Data

Apr. 20, 2000 (DE) ..... 100 19 568

(51) Int. Cl.[7] ..... G01L 5/04; G01N 33/00; G01N 33/34

(52) U.S. Cl. ..... 73/159; 73/866

(58) Field of Search ..... 73/866, 159

(56) References Cited

U.S. PATENT DOCUMENTS 5,400,258 A * 3/1995 He ..... 364/471
5,735,059 A * 4/1998 Schmit et al. ..... 34/117
6,231,722 B1 * 5/2001 Vestola ..... 162/198

FOREIGN PATENT DOCUMENTS

| | | |
|---|---|---|
| DE | 19782179 | 11/1999 |
| DE | 19911395 | 9/2000 |
| WO | 98/27275 | 6/1998 |

* cited by examiner

*Primary Examiner*—Hezron Williams
*Assistant Examiner*—Rodney Frank
(74) *Attorney, Agent, or Firm*—Greenblum & Bernstein, P.L.C.

(57) ABSTRACT

Measuring system and process for determining properties of a running fibrous material web in a drying section of a machine producing the fibrous material web. The system includes at least one upper roll and at least one lower roll. The fibrous material web is arranged to partially wrap the at least one upper roll and the at least one lower roll and to run between these rolls at an angle between about 0 and 45° to a vertical. A sensor guide is arranged crosswise to a web run direction, and at least one sensor is arranged to traverse the sensor guide in the web run direction in a region of the at least one lower roll. The sensor is structured and arranged for determining a web parameter, and is oriented to form a maximum angle of about 60° to a horizontal through an axis of the lower roll.

23 Claims, 1 Drawing Sheet

MEASURING SYSTEM

CROSS-REFERENCE TO RELATED APPLICATIONS

The present application claims priority under 35 U.S.C. §119 of German Patent Application No. 100 19 568.7, filed on Apr. 20, 2000, the disclosure of which is expressly incorporated by reference herein in its entirety.

BACKGROUND OF THE INVENTION

1. Field of the Invention

The invention relates to a measuring system for determining properties of a running paper, cardboard, tissue, or other fibrous material web, in particular arranged in the drying section of a machine for the production and/or finishing thereof, in which the fibrous material web partially wraps at least one upper and one lower roll and an angle of 0 to 45° to a vertical runs between these rolls, with at least one sensor for detecting a web property being arranged in the region of the lower roll on a sensor guide traversing the fibrous material web in a crosswise manner.

2. Discussion of Background Information

In order to optimize the production and/or finishing process, it is constantly becoming more important to detect the operating condition of the running fibrous material web. These values can then be used, for example, in controls for the purpose of profiling.

Because of the high speeds, supporting the fibrous material web in these machines with a belt or a roll is indispensable, which makes measurement even more difficult with respect to accessibility and accuracy.

Furthermore, in stationary measuring systems, considerable problems result from the soiling of the sensor and the sensor guide. Added to this is the difficult accessibility for cleaning and maintenance.

SUMMARY OF THE INVENTION

The present invention decreases the soiling of the stationary measuring system and improves the accessibility of the measuring system to the greatest extent possible.

According to the invention, the sensor is arranged in a position in which it forms an angle with a maximum value of about 60° with a horizontal with respect to the axis of the lower roll.

These positions lie in the region of the fibrous material web, which is running more or less vertically upwards or downwards. In this region, soiling can be best prevented because web residuals, or similar parts that have been entrained, fall through the gap between the sensor and the fibrous material web into the machine cellar. If the sensor is attached below the axis of the lower roll, it is advantageous for the sensor to form an angle with a maximum value of about 30° with a horizontal with respect to the axis of the lower roll. If the sensors are arranged above the axis of the lower roll, the angle with the horizontal is limited by the minimum distance from the fibrous material web. In the instant invention, the fibrous material web is supported by the lower roll during measurement or is running between the upper and lower rolls.

The same advantages with respect to soiling occur when the sensor guide also runs in a position above or below the axis of the lower roll in that it forms an angle with a maximum value of about 60° with the horizontal with respect to the axis of the lower roll. In the case of sensor guides that are positioned below the axis of the lower roll, it is also advantageous for the sensor guide to form an angle with a maximum value of about 30° to the horizontal with respect to the axis of the lower roll.

The sensor and/or the sensor guide can also be arranged at the height of the lower roll.

The positions of the sensor and sensor guide are naturally to be regarded in connection with one another, the sensor should be allowed the best possible protection from soiling in the interests of measuring accuracy. Here, the placement of the sensors in the sensor guide could also be advantageous.

Depending on the requirements, the sensor guide can incorporate several sensors or several sensor guides can be present for each one or more sensor(s).

It is generally important for the measuring results for the sensors to maintain a constant distance from the fibrous material web during traversing. One basis for this is the support of the fibrous material web, preferably along with a belt on the lower roll. This belt can guide the fibrous material web between the upper and the lower roll, with the fibrous material web being directly in contact with the upper roll.

For reasons of safety of the device and in order to guarantee a sufficiently large space for impurities to drop into the machine cellar, the sensor should be arranged at a distance from the fibrous material web, preferably from the lower roll as well, of between about 3 and 50 cm, in particular between about 8 and 25 cm.

It is further advantageous here for the sensor preferably to be arranged together with the sensor guide on the web exit side of the lower roll. This simplifies the insertion of the fibrous material web and the transfer of a strip of it and reduces the danger of soiling.

Nevertheless, the sensor and the sensor guide should be protected from soiling by deflecting plates or the like. Furthermore, it is advantageous for the sensor guide to be structured in such a way that it allows a movement of the sensor across the width of the fibrous material web at least on one side of the machine, preferably past the rolls. This makes it possible for the sensor to be moved into the areas of the fibrous material web in danger of soiling only for measuring. The ability of the sensor to be moved past the rolls allows its maintenance and cleaning even while the machine is in operation.

In order to guarantee a stable sensor guide as well as a simple construction, the sensor guide should be connected on at least one side of the machine to its seating or foundation.

Depending on the type of control or regulation as well as on the place of measurement in the machine, the sensor can detect the temperature and/or the moisture and/or a tear of the fibrous material web. Because of the significance of these measuring results for influencing the moisture cross profile, the use of the measuring system in a drying section of a paper machine is particularly advantageous. For this purpose, the upper roll should be embodied as a heated drying cylinder and/or the lower roll as a suctioned guide roll and/or the belt as a drying wire. However, depending on the type of drying section, the lower roll can also be formed by a normal roll (guide or drying roll).

It is also possible to use this measuring system in the pressing section for dewatering the fibrous material web or between the pressing section and the drying section. Here, the belt can be embodied as a pressing felt, transfer belt, or a drying wire.

The present invention is directed to a measuring system for determining properties of a running fibrous material web in a drying section of a machine for producing or finishing the fibrous material web. The system comprises at least one upper roll and at least one lower roll. The fibrous material web is arranged to partially wrap at least one upper roll and at least one lower roll and to run between at least one upper roll and at least one lower roll at an angle between about 0 and 45° to a vertical. A sensor guide is arranged crosswise to a web run direction, and at least one sensor is arranged to traverse the sensor guide in the web run direction in a region of at least one lower roll. At least one sensor is structured and arranged for determining a web parameter, and at least one sensor is oriented to form a maximum angle of about 60° to a horizontal through an axis of at least one lower roll.

In accordance with a feature of the instant invention, the fibrous material web can be one of paper, cardboard, or tissue.

In accordance with another feature of the invention, the at least one sensor can be positioned below the axis of the at least one lower roll and can be oriented to form a maximum angle of about 30° to the horizontal through the axis of the at least one lower roll.

According to still another feature of the invention, at least one sensor may be arranged above the axis of at least one lower roll.

Further, the at least one sensor guide may be arranged to form a maximum angle of about 60° to the horizontal through the axis of at least one lower roll. At least one sensor guide may be located below the axis of at least one lower roll and can be arranged to form a maximum angle of about 30° to the horizontal through the axis of at least one lower roll. Still further, at least one sensor guide can be located above the axis of at least one lower roll.

According to a further feature of the invention, at least one sensor may be arranged on a web exit side of at least one lower roll.

At least one sensor can be arranged, along with the sensor guide, on a web exit side of at least one lower roll.

Moreover, the sensor guide can be structured to facilitate movement of at least one sensor over a width of the fibrous material web at least on one side of the machine. The sensor guide can be structured to facilitate movement of at least one sensor over a width of the fibrous material web and beyond a width of at least one upper and lower rolls.

In accordance with a still further feature of the present invention, at least one sensor guide can be coupled to at least one of a seating and a foundation of the machine at least on one side of the machine.

At least one sensor may be located a distance from the fibrous material web of between about 3 and 50 cm. Further, at least one sensor can be located a distance from the material web of between about 8 and 25 cm.

At least one sensor may be located a distance from at least one lower roll of between about 3 and 50 cm. Further, at least one sensor can be located a distance from at least one lower roll of between about 8 and 25 cm.

According to another feature of the invention, at least one sensor may be arranged to detect at least one of a temperature and a moisture of the fibrous material web.

In accordance with still another feature of the instant invention, at least one upper roll may include a heated drying cylinder.

In accordance with another feature of the invention, at least one lower roll can include a suctioned guide roll.

According to still another feature of the present invention, a belt can be arranged to guide the fibrous material web through the machine. The belt may include a drying wire.

In accordance with yet another feature of the instant invention, a doctor can be arranged against the surface of at least one upper roll, and at least one sensor may be arranged so that materials removed by the doctor do not soil the sensor(s).

The present invention is directed to a process for determining properties of a running fibrous material web in a drying section of a machine for producing or finishing the fibrous material web, which includes at least one upper roll, at least one lower roll, a sensor guide and at least one sensor. The process includes guiding the fibrous material web to partially wrap at least one upper roll and at least one lower roll. The fibrous material web is also arranged to run between at least one upper roll and at least one lower roll at an angle between about 0 and 45° to a vertical. The process also includes moving at least one sensor, which is oriented to form a maximum angle of about 60° to a horizontal through an axis of at least one lower roll, to a web run direction in a region of at least one lower roll, where at least one sensor is structured and arranged for determining a web parameter.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

Figure 1:
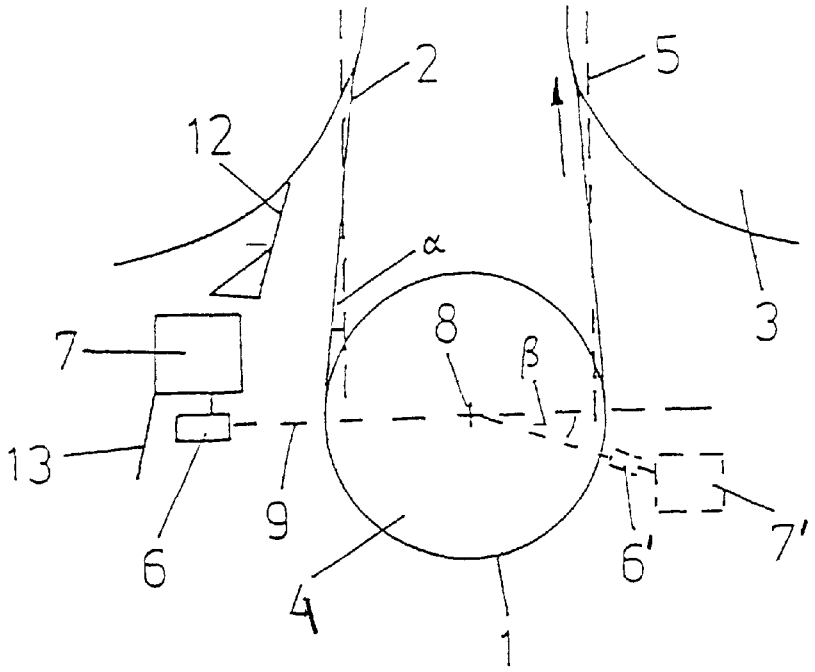
FIG. 1 a schematic cross section of part of a drying section of a paper machine.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

The drying section includes two rows of rolls 3, 4, with the upper rolls 3 being embodied as heated drying cylinders and the lower rolls 4 being embodied as suctioned guide rolls. The suctioned guide rolls have a perforated roll jacket whose inner chamber is connected to a vacuum source. In order to dry the fibrous material web 1, it is alternately guided over the heated drying cylinders and the suctioned guide rolls, with the fibrous material web 1 being constantly supported by a belt 2 in the form of a drying wire, at least inside one drying group of the drying section, and coming directly into contact with the drying cylinders. Here, the fibrous material web 1 runs between the upper and lower rolls 3, 4 together with the belt 2 approximately at an angle α of about 20° to a vertical 5.

A sensor 6 for measuring the temperature and moisture content of the fibrous material web 1 is located in the region of the lower roll 4. These measured values are taken into account when influencing the moisture cross profile of the fibrous material web 1 using steam blow boxes, nozzle misters, and the like. For this purpose, the sensor 6 is attached to a sensor guide 7 in a traversable manner, which allows the web parameters to be detected in a crosswise manner across the entire fibrous material web 1.

In FIG. 1, a sensor 6 with a sensor guide 7 is arranged across from the lower roll 4, with the fibrous material web 1 along with the belt 2 running from the upper roll 3 to the lower roll 4. Here, the sensor 6 lies on the horizontal 9 running through the axis 8 of the lower roll 4. The distance between the sensor 6 and the fibrous material web 1 is approximately 10 cm. The gap formed thereby is sufficiently large that impurities can fall into the machine cellar in a problem-free manner, where they are collected and removed.

Furthermore, the upper roll 3 is engaged by a doctor 12 whose doctor blade removes impurities from the upper roll 3. This doctor 12 is structured in such a way that impurities scraped off by it can fall through the gap between the sensor 6 and the fibrous material web 1. Furthermore, a guide plate 13 should additionally protect the sensor 6 and the sensor guide 7 from impurities.

On the other side, namely the web exit side of the lower roll 4, i.e., the place where the fibrous material web 1 with the belt 2 runs to the upper roll 3, another sensor 6' with a sensor guide 7' is sketched in dashed lines. This is meant to refer to an essential alternative for the arrangement of the sensor 6' and the sensor guide 7'. Because there is no doctor in the vicinity of the web exit side, the danger of soiling is reduced here. The downward removal of the fibrous material web (upon threading or tearing of the same) is problem-free such that a lesser danger of damage to the sensor 6 exists on the web exit side.

It is also significant that the sensor 6' and, if possible, also the sensor guide 7', is arranged in a position in which it forms an angle β of a maximum of about 60° with the horizontal 9 with respect to the axis 8 of the lower roll 4. Because, as implied, the sensor 6' and the sensor guide 7' are located here under the axis 8 of the lower roll 4, the angle β is actually much smaller, namely approximately 20°. This small angle β guarantees that falling impurities can fall through the gap between the sensor 6' and the fibrous material web 1, which is, for example, approximately 10 cm wide. Because the fibrous material web 1 is traveling towards the upper roll 3 here, entrained and falling web residuals are fairly rare, so that further protective measures can be eliminated.

Figure 2:
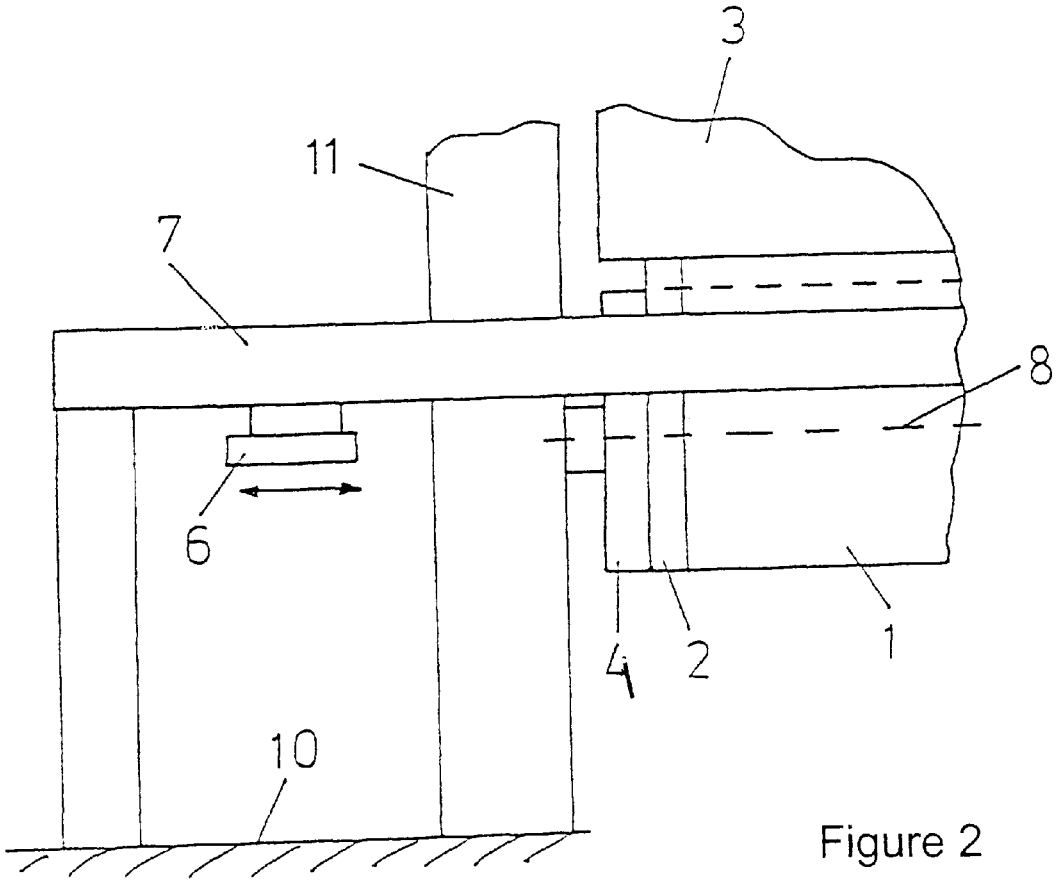
FIG. 2 an end of the sensor guide 7.

FIG. 2 shows a part of the seating 11 of the drying section, which carries, in particular, the upper roll 3 and the lower roll 4. Here, the sensor guide 7 is pulled sufficiently far out of the machine that the sensor 6 can be moved outside the region of the rolls 3, 4. This allows the sensor 6 to be moved in the region in danger of soiling only for the purpose of measuring. For the purpose of stabilizing the construction, the sensor guide 7 is connected to the base 10 of the machine, which has a positive effect on measuring accuracy.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A measuring system for determining properties of a running fibrous material web in a drying section of a machine for producing or finishing the fibrous material web, comprising:

at least one upper roll;

at least one lower roll, wherein the fibrous material web is arranged to partially wrap said at least one upper roll and said at least one lower roll and to run between said at least one upper roll and said at least one lower roll at an angle between about 0 and 45° to a vertical;

a sensor guide arranged crosswise to a web run direction;

at least one sensor arranged to traverse said sensor guide crosswise to the web run direction in a region of said at least one lower roll, said at least one sensor being structured and arranged for determining a web parameter;

at least one belt arranged between said upper roll and said lower roll to support the web running between said upper roll and said lower roll; and said at least one sensor being oriented to form a maximum angle of about 60° to a horizontal through an axis of said at least one lower roll.

2. The measuring system in accordance with claim 1, wherein the fibrous material web is one of paper, cardboard, or tissue.

3. The measuring system in accordance with claim 1, wherein said at least one sensor is positioned below the axis of said at least one lower roll and is oriented to form a maximum angle of about 30° to the horizontal through the axis of said at least one lower roll.

4. The measuring system in accordance with claim 1, wherein said at least one sensor is arranged above the axis of said at least one lower roll.

5. The measuring system in accordance with claim 1, wherein said at least one sensor guide is arranged to form a maximum angle of about 60° to the horizontal through the axis of said at least one lower roll.

6. The measuring system in accordance with claim 5, wherein said at least one sensor guide is located below the axis of said at least one lower roll and is arranged to form a maximum angle of about 30° to the horizontal through the axis of said at least one lower roll.

7. The measuring system in accordance with claim 5, wherein said at least one sensor guide is located above the axis of said at least one lower roll.

8. The measuring system in accordance with claim 1, wherein said at least one sensor is arranged on a web exit side of said at least one lower roll.

9. The measuring system in accordance with claim 1, wherein said at least one sensor is arranged, along with said sensor guide, on a web exit side of said at least one lower roll.

10. The measuring system in accordance with claim 1, wherein said sensor guide is structured to facilitate movement of said at least one sensor over a width of the fibrous material web at least on one side of the machine.

11. The measuring system in accordance with claim 10, wherein said sensor guide is structured to facilitate movement of said at least one sensor over a width of the fibrous material web and beyond a width of said at least one upper and lower rolls.

12. The measuring system in accordance with claim 1, wherein said at least one sensor guide is coupled to at least one of a seating and a foundation of the machine at least on one side of the machine.

13. The measuring system in accordance with claim 1, wherein said at least one sensor is located a distance from the fibrous material web of between about 3 and 50 cm.

14. The measuring system in accordance with claim 13, wherein said at least one sensor is located a distance from the material web of between about 8 and 25 cm.

15. The measuring system in accordance with claim 1, wherein said at least one sensor is located a distance from said at least one lower roll of between about 3 and 50 cm.

16. The measuring system in accordance with claim 15, wherein said at least one sensor is located a distance from said at least one lower roll of between about 8 and 25 cm.

17. The measuring system in accordance with claim 1, wherein said at least one sensor is arranged to detect at least one of a temperature and a moisture of the fibrous material web.

18. The measuring system in accordance with claim 1, wherein said at least one upper roll comprises a heated drying cylinder.

19. The measuring system in accordance with claim 1, wherein said at least one lower roll comprises a suctioned guide roll.

20. The measuring system in accordance with claim 1, said at least one belt is arranged to guide the fibrous material web through the machine.

21. The measuring system in accordance with claim 20, wherein said belt comprises a drying wire.

22. The measuring system in accordance with claim 1, further comprising a doctor arranged against the surface of said at least one upper roll, wherein said at least one sensor is arranged so that materials removed by said doctor do not soil said at least one sensor.

23. A process for determining properties of a running fibrous material web in a drying section of a machine for producing or finishing the fibrous material web, which includes at least one upper roll, at least one lower roll, a sensor guide, a support belt, and at least one sensor, said process comprising:

guiding the fibrous material web on the support belt to partially wrap at least one upper roll and at least one lower roll, wherein the fibrous material web is arranged to run between at least one upper roll and at least one lower roll at an angle between about 0 and 45° to a vertical while supported on the support belt; and moving at least one sensor, which is oriented to form a maximum angle of about 60° to a horizontal through an axis of at least one lower roll, crosswise to a web run direction in a region of at least one lower roll, wherein at least one sensor is structured and arranged for determining a web parameter.

* * * * *